US008448575B2

(12) United States Patent
Goddard

(10) Patent No.: US 8,448,575 B2
(45) Date of Patent: May 28, 2013

(54) FIREARM CARTRIDGE

(76) Inventor: Jeffrey D. Goddard, Barre, VT (US)

( * ) Notice: Subject to any disclaimer, the term of this patent is extended or adjusted under 35 U.S.C. 154(b) by 0 days.

(21) Appl. No.: 11/193,861

(22) Filed: Jul. 29, 2005

(65) Prior Publication Data

US 2007/0022897 A1 Feb. 1, 2007

(51) Int. Cl.
*F42B 5/02* (2006.01)

(52) U.S. Cl.
USPC ..... 102/430; 102/464; 86/19.5

(58) Field of Classification Search
USPC ..... 102/464, 430, 439; 86/19.5, 19.6, 86/464; 89/194, 195; 42/7
See application file for complete search history.

(56) References Cited

U.S. PATENT DOCUMENTS

| | | | | |
|---|---|---|---|---|
| 2,321,737 | A * | 6/1943 | Engel | 102/446 |
| 2,373,921 | A * | 4/1945 | Snell | 86/19.5 |
| 2,402,068 | A * | 6/1946 | Meador | 148/643 |
| 2,442,841 | A * | 6/1948 | Catlin et al. | 86/19.5 |
| 3,705,515 | A * | 12/1972 | Lee | 72/370.13 |
| 3,998,161 | A * | 12/1976 | Booth | 102/464 |
| 4,442,777 | A * | 4/1984 | Greene | 102/444 |
| 4,955,157 | A * | 9/1990 | Brighton et al. | 42/77 |
| 6,293,203 | B1 * | 9/2001 | Alexander et al. | 102/430 |
| 7,011,028 | B1 * | 3/2006 | Emary | 102/464 |
| 7,047,686 | B2 * | 5/2006 | Zimmermann | 42/75.1 |
| 7,318,294 | B2 * | 1/2008 | Zimmermann | 42/7 |
| 2003/0101891 | A1 * | 6/2003 | Amick | 102/514 |
| 2004/0074412 | A1 * | 4/2004 | Kightlinger | 102/430 |
| 2005/0257413 | A1 * | 11/2005 | Zimmermann | 42/75.1 |

OTHER PUBLICATIONS

Ref A. "The RCBS.Load Cartridge Designer Utility." http://www.gmdr.com/rcbs.rcbstext9.htm. Found via WayBackMachine for the date of Jan. 14, 2003. 5 pages.*

Speer, Speer Reloading Manual: Rifle and Pistol, 1998, Blount Inc Sporting Equipment Division, No. 13, pp. 244-248, 277-279, 368-375, 430.*

Wikipedia reference page: http://en.wikipedia.org/wiki/9mm, Oct. 4, 2008, "9 mm Caliber", Article lists firearm cartridges which have a bullet in the 9mm (.354 in) caliber range.*

* cited by examiner

*Primary Examiner* — Benjamin P Lee
(74) *Attorney, Agent, or Firm* — Steven M. McHugh

(57) ABSTRACT

An improved 9 mm cartridge is provided and includes a 9 mm bullet, wherein the 9mm bullet weights at least 90 grains and is configured for operation with a 9 mm firearm, a 0.45 caliber Win Mag cartridge case having a case bottom portion communicated with a case top portion via a case middle portion, wherein the case bottom portion, the case middle portion and the case top portion define a case cavity and wherein the case top portion includes a top opening communicated with the case cavity, the top opening sized to interact with the 9 mm bullet. The improved 9 mm cartridge also includes a propellant for propelling the 9 mm bullet to a velocity of at least 1600 feet per second.

20 Claims, 15 Drawing Sheets

Section Z - Z

FIREARM CARTRIDGE

FIELD OF THE INVENTION

This disclosure relates generally to ammunition for a firearm, and more particularly to a 9 mm cartridge having a greater lethality.

BACKGROUND OF THE INVENTION

Since George Luger developed the P-08 9 mm Luger for the German Army in 1902, the nine millimeter (9 mm) cartridge has become one of the world's most popular and widely used firearm cartridges for pistols and submachine guns. In fact, in 1985, the United States Military adopted the M9 Baretta 9 mm pistol, which uses the 9 mm cartridge (M882), as its official sidearm. Referring to FIG. 1, as like most cartridges, the 9 mm cartridge 100 is typically comprised of a bullet 102 that is sealingly and snugly associated with a casing 104, wherein the casing 104 contains an explosive charge, such as gun powder 106 and a primer or cap 108 which is a small metal cup containing a detonating mixture 110 used to ignite the explosive power 106.

Referring to FIG. 2 and FIG. 3, a typical 9 mm firearm 112 is shown and includes a barrel 114 defining a muzzle opening 116 communicated with a chamber 118 via a barrel cavity 120. The firearm 112 also includes a magazine 122 for holding a plurality of cartridges 100 and a hammer 124 associated with a firing pin 128 which is further associated with the chamber 118. The hammer 124 is typically associated with a compression device 126 which when triggered causes the hammer 124 to interact with the firing pin 128 such that the firing pin 128 strikes the cap 108 of the cartridge 100 when the cartridge 100 is disposed within the chamber 118. As such, when the cartridge 100 is disposed within the chamber 118 of the firearm 112 and the compression device 126 is triggered, the firing pin 128 strikes the cap 108 of the cartridge 100 causing the cap 108 to detonate. This ignites the gun powder 106 within the casing 104 resulting in a rapid buildup of gas pressure between the bullet 102 and the casing 104. This pressure build up results in the bullet 102 being propelled at high velocity away from the casing 104, down the barrel 114 of the firearm 112 and out of the muzzle opening 116.

Although the popularity of the 9 mm firearm 112 and thus, the 9 mm cartridge 100, is due in large part to its reliability, the 9 mm firearm 112 has several disadvantages over larger caliber weapons. One such disadvantage involves the lethality of the 9 mm bullet 102 as compared with that of the 0.45 caliber bullet. Lethality, which is a reflection of the ability of a bullet to stop, or kill, an assailant, may be determined by the weight or mass of the bullet and its velocity at the point of impact. For example, a typical 9 mm cartridge 100 includes a bullet 102 weighing approximately 115-124 grains and holds enough explosive powder to propel the bullet 102 at a velocity of approximately 1150-1250 feet per second (fps) when fired. Unfortunately however, given this mass and velocity, the 9 mm bullet 102 does not achieve the desired level of lethality because the 9 mm bullet 102 does not have enough kinetic energy to impart against the human body. On the other hand, although the velocity of the 0.45 caliber bullet is slower than the 9 mm bullet 102, the 0.45 caliber bullet includes a much larger mass than the 9 mm bullet 102 and thus achieves a greater amount of kinetic energy than the 9 mm bullet 102. As such, when the 0.45 caliber bullet impacts a target, such as a human body, this greater amount of kinetic energy is transferred from the bullet to the soft tissue of the body allowing the 0.45 caliber bullet to achieve a higher lethality than the 9 mm bullet 102.

Unfortunately however, because of its relatively slow velocity, the 0.45 caliber bullet (and for that matter the 9 mm bullet 102) has a limited range and accuracy beyond thirty (30) yards. As such, this lack of accuracy typically causes a shooter to either expend numerous rounds to stop an adversary or to wait until the adversary is dangerously close before firing. This is undesirable because the shooter may either expend all of his/her ammunition or the shooter may be injured by letting the adversary to get dangerously close. Another disadvantage with the 9 mm bullet 102 and the 0.45 caliber bullet involves the currently achievable kinetic energy levels of these bullets. This is because at the currently achievable energy levels, the 9 mm bullet 102 and the 0.45 caliber bullet do not have the ability to penetrate the soft body armor currently used by our adversaries. Thus, the body armor tends to increase the likelihood that an adversary will survive a military engagement with allied armies. This is an undesirable situation because it may provide the adversary with additional opportunities to cause damage and harm to allied armies and/or citizens.

SUMMARY OF THE INVENTION

An improved 9 mm cartridge is provided and includes a 9 mm bullet, wherein the 9 mm bullet weights at least 90 grains and is configured for operation with of a 9 mm firearm. The improved 9 mm cartridge also includes a 0.45 caliber Win Mag cartridge case having a case bottom portion communicated with a case top portion via a case middle portion, wherein the case bottom portion, the case middle portion and the case top portion define a case cavity and wherein the case top portion includes a top opening communicated with the case cavity, the top opening being sized to interact with the 9 mm bullet, wherein the 9 mm bullet is frictionally associated with the top opening such that at least a portion of the 9 mm bullet is disposed within the case cavity. The improved 9 mm cartridge also includes a means for propelling the 9 mm bullet to a velocity of at least 1600 feet per second, wherein the means for propelling is at least partially disposed within the casing cavity and a cap, wherein the cap is associated with the case bottom portion such that when the cap is engaged, the cap causes the means for propelling the 9 mm bullet to propellingly interact with the 9 mm bullet.

An improved 9 mm cartridge is provided and includes a 9 mm bullet, wherein the 9 mm bullet weights at least 90 grains and is configured for operation with a 9 mm firearm. The cartridge further includes a cartridge case having a case bottom portion communicated with a case top portion via a case middle portion, wherein the case bottom portion includes a first case bottom portion diameter disposed on one end of the case bottom portion and approximately equal to 0.4738 inches, wherein the first case bottom portion diameter may vary by a tolerance range of approximately ±0.004 inches, and a second case bottom portion diameter disposed on an opposite end of the case bottom portion approximately equal to 0.4640 inches, wherein the second case bottom portion diameter may vary by a tolerance range of approximately ±0.004 inches, and wherein the case bottom portion, the case middle portion and the case top portion define a case cavity and wherein the case top portion includes a top opening communicated with the case cavity, the top opening being sized to operatively interact with the 9 mm bullet. Additionally, a means for propelling the 9 mm bullet to a velocity of at least 1600 feet per second is also included, wherein the means for propelling is at least partially disposed within the casing cavity and a cap, wherein the cap is associated with the case bottom portion such that when the cap is engaged, the cap causes the means for propelling the 9 mm bullet to propellingly interact with the 9 mm bullet.

A method for generating an improved 9 mm cartridge is provided, wherein the method includes constructing a cartridge case, wherein the cartridge case defines a case cavity and includes a cap, a case bottom portion having a case bottom portion diameter and a case top portion having a case top portion diameter, wherein the case bottom portion diameter is substantially equal to that of a 0.45 Winchester Magnum cartridge and wherein the case top portion diameter is sized to operatively interact with a 9 mm firearm. The method further includes introducing a predetermined amount of propellant into the case cavity, the predetermined amount of propellant being sufficiently large to propel a 9 mm bullet having a mass of at least 90 grains to a velocity of at least 1600 feet per second and associating the bullet with the cartridge case, such that the bullet is frictionally associated with the cartridge case.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION

Figure 1:
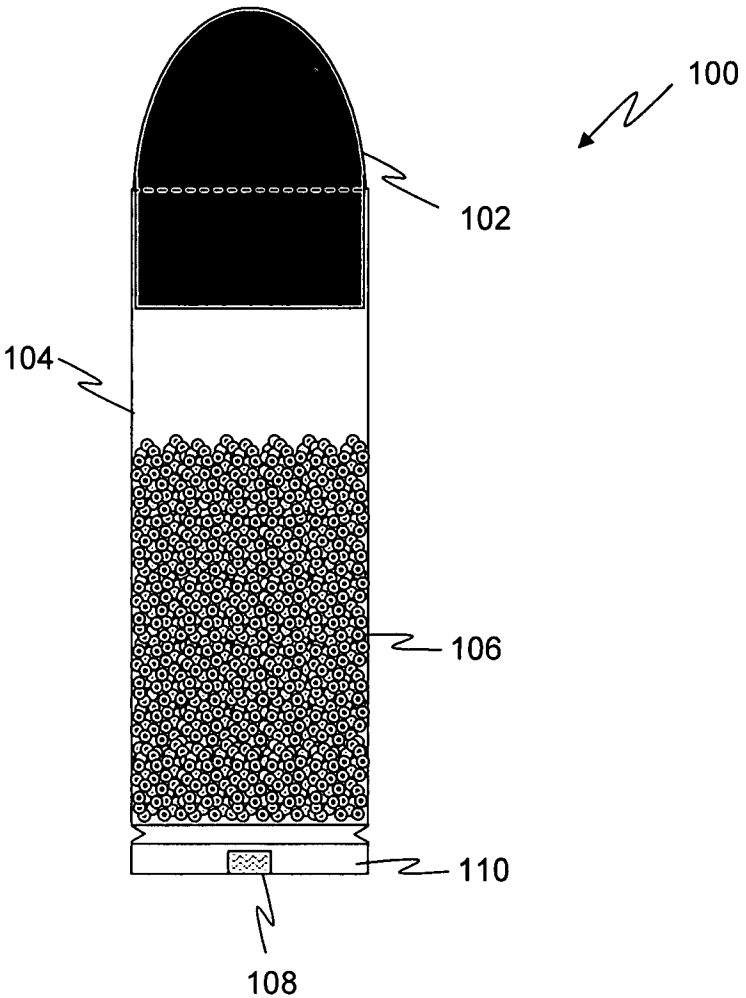
Figure 1 PRIOR ART
FIG. 1 is a sectional side view of a 9 mm cartridge in accordance with the prior art.
Figure 2:
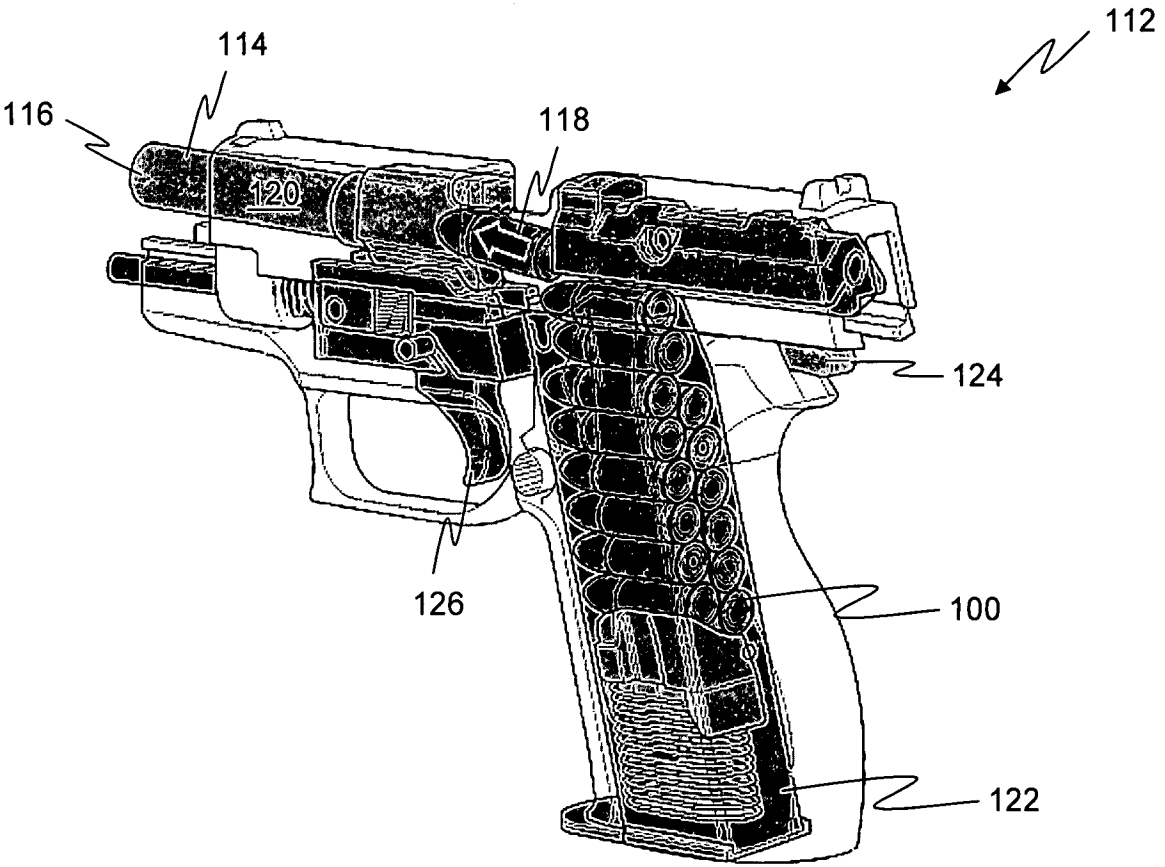
Figure 2 PRIOR ART
FIG. 2 is a side cross sectional perspective view of a 9 mm firearm employing the 9 mm cartridge of FIG. 1, in accordance with the prior art.
Figure 3:
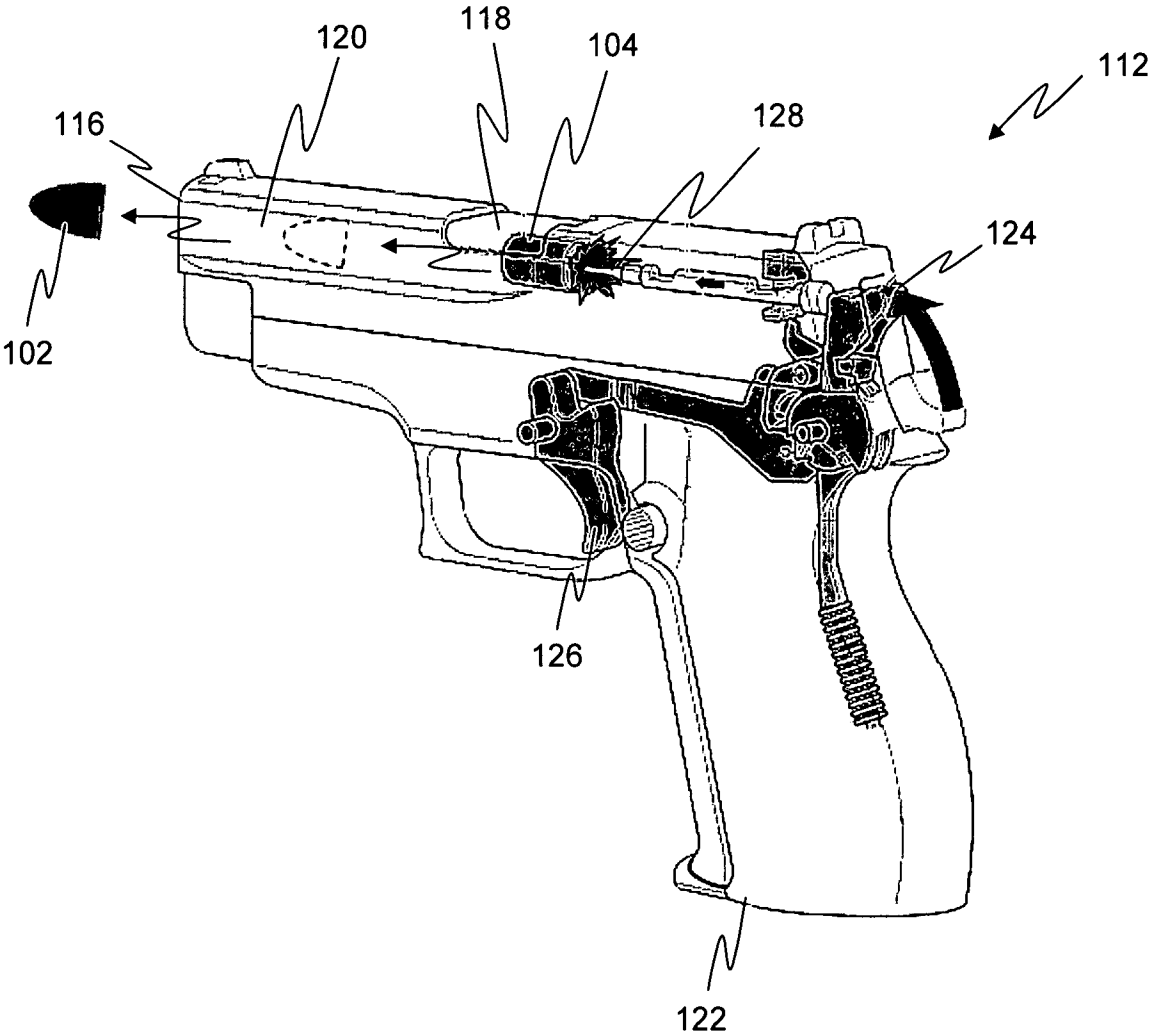
Figure 3 PRIOR ART
FIG. 3 is a side cross sectional perspective view of a 9 mm firearm employing the 9 mm cartridge of FIG. 1, in accordance with the prior art.
Figure 4:
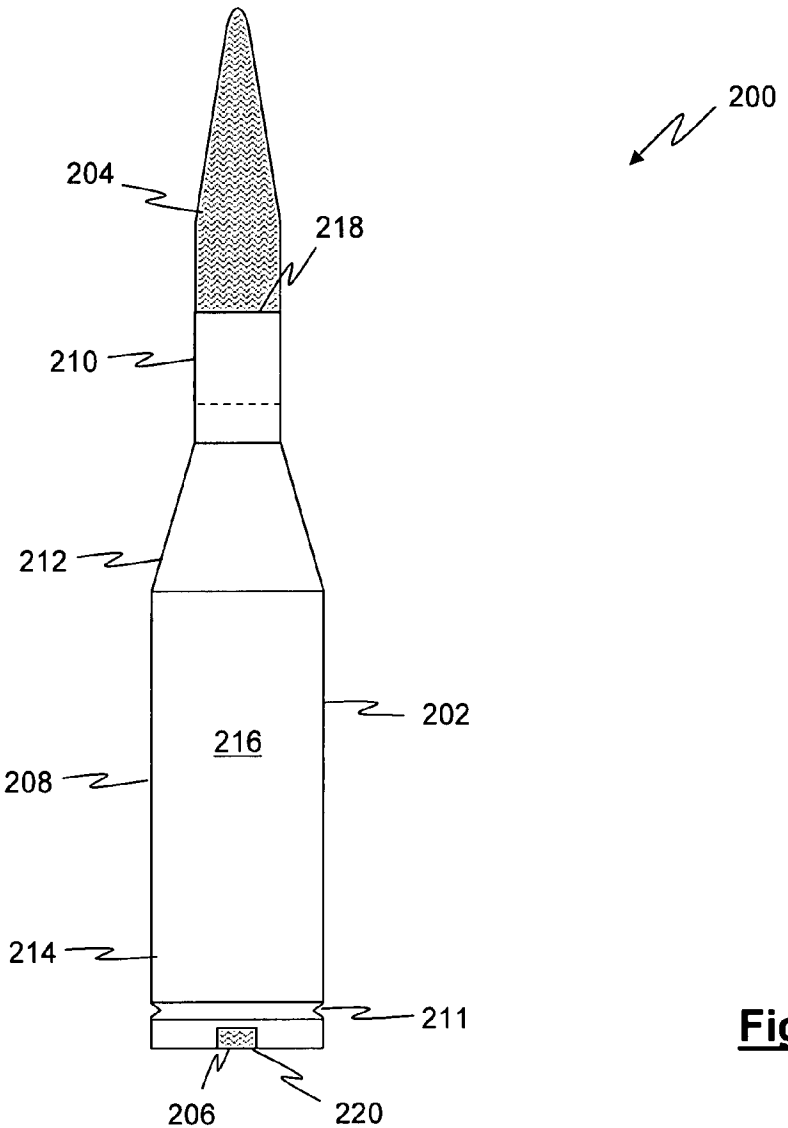
FIG. 4 is a side view of an improved 9 mm cartridge, in accordance with an exemplary embodiment.
Figure 5:
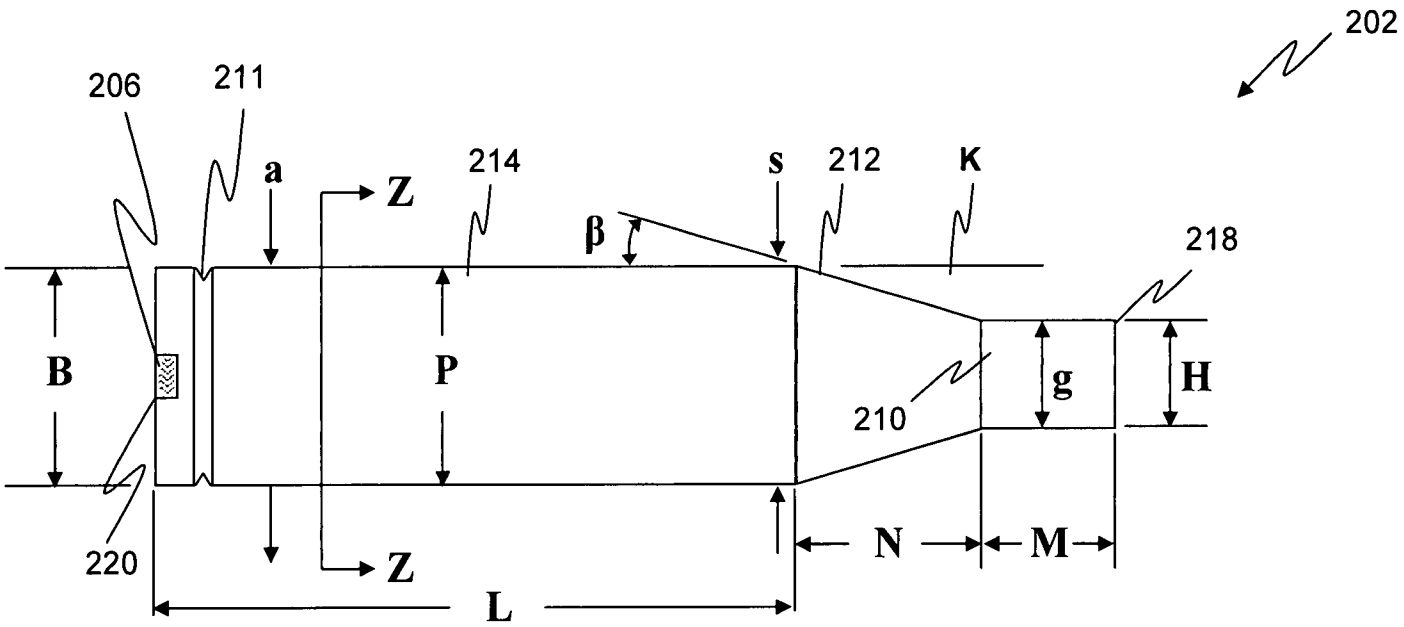
FIG. 5 is a side view of a cartridge case for the improved 9 mm cartridge in FIG. 4.

Referring to FIG. 4, a first embodiment of an improved 9 mm cartridge 200 is shown and includes a cartridge case 202, a bullet 204 and a primer or cap 206. The cartridge case 202 includes a casing structure 208 having a casing top portion 210, a casing center portion 212 and a casing bottom portion 214, wherein the casing structure 208 defines a casing cavity 216 such that the casing top portion 210 is communicated with the casing bottom portion 214 via the casing cavity 216. The casing top portion 210 defines a top opening 218 and the casing bottom portion 214 defines a bottom opening 220, wherein the top opening 218 is communicated with the bottom opening 220 via the casing cavity 216 and wherein the bottom opening is sized and shaped to securingly contain the cap 206. As shown in FIG. 5, the casing bottom portion 214 may also include an extractor interface portion 211 for interfacing with the ejector of a firearm and a casing bottom portion length L which may be approximately equal to 0.7480 inches. The casing bottom portion 214 also includes a first casing bottom portion diameter a disposed adjacent the cap 206 which may be approximately equal to 0.4738 inches and a second casing bottom portion diameter s disposed adjacent the casing center portion 212 which may be approximately equal to 0.4640 inches, wherein the casing bottom portion 214 is tapered between the first casing bottom portion diameter a and the second casing bottom portion diameter s.

Figure 6:
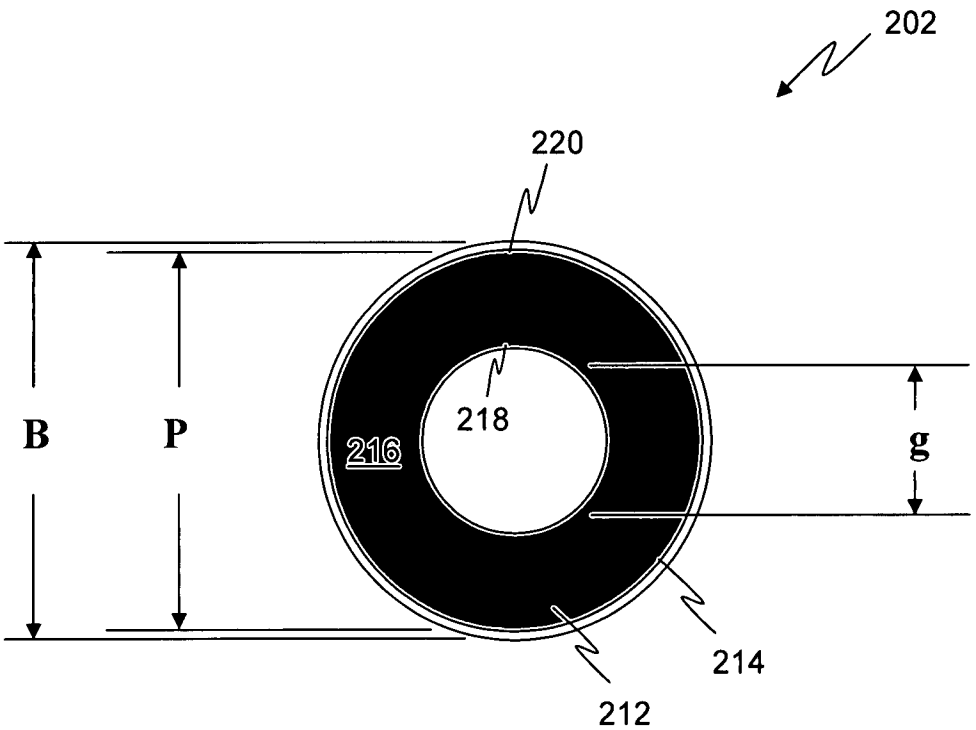
FIG. 6 is a bottom up view of the interior of the cartridge case for the improved 9 mm cartridge in FIG. 4.

The casing top portion 210 includes a casing top portion length M which may be approximately equal to 0.1285 inches, a casing top portion inner diameter g which may be approximately equal to 0.3550 inches and a casing top portion outer diameter H which may be approximately equal to 0.3810 inches, wherein the casing bottom portion 214 is separated from the casing top portion 210 by the casing center portion 212. The casing center portion 212 includes a casing center portion length N which may be approximately equal to 0.236 inches and which may be tapered at an angle β relative to a plane K disposed parallel to the casing bottom portion 214, wherein β may be approximately equal to 20°. Additionally, referring to FIG. 6, the casing bottom portion 214 also includes a casing cavity diameter P, which traverses the casing bottom portion length L and which is sized and shaped to contain an amount of propellant sufficient to propel the bullet 204 at a velocity of at least 1600 feet per second. It should be appreciated that the case cavity diameter P may be uniformly sized or may be varied in size as desired, such as with a taper.

Figure 7:
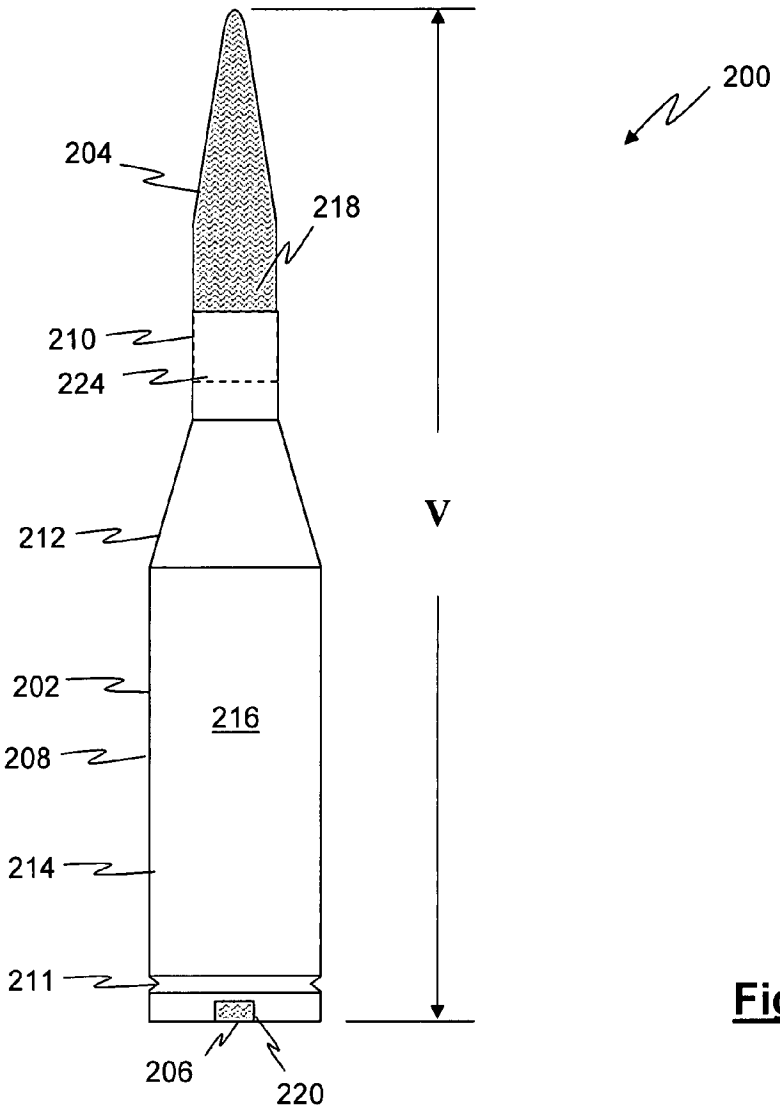
FIG. 7 is a side view of the improved 9 mm cartridge in FIG. 4.
Figure 8:
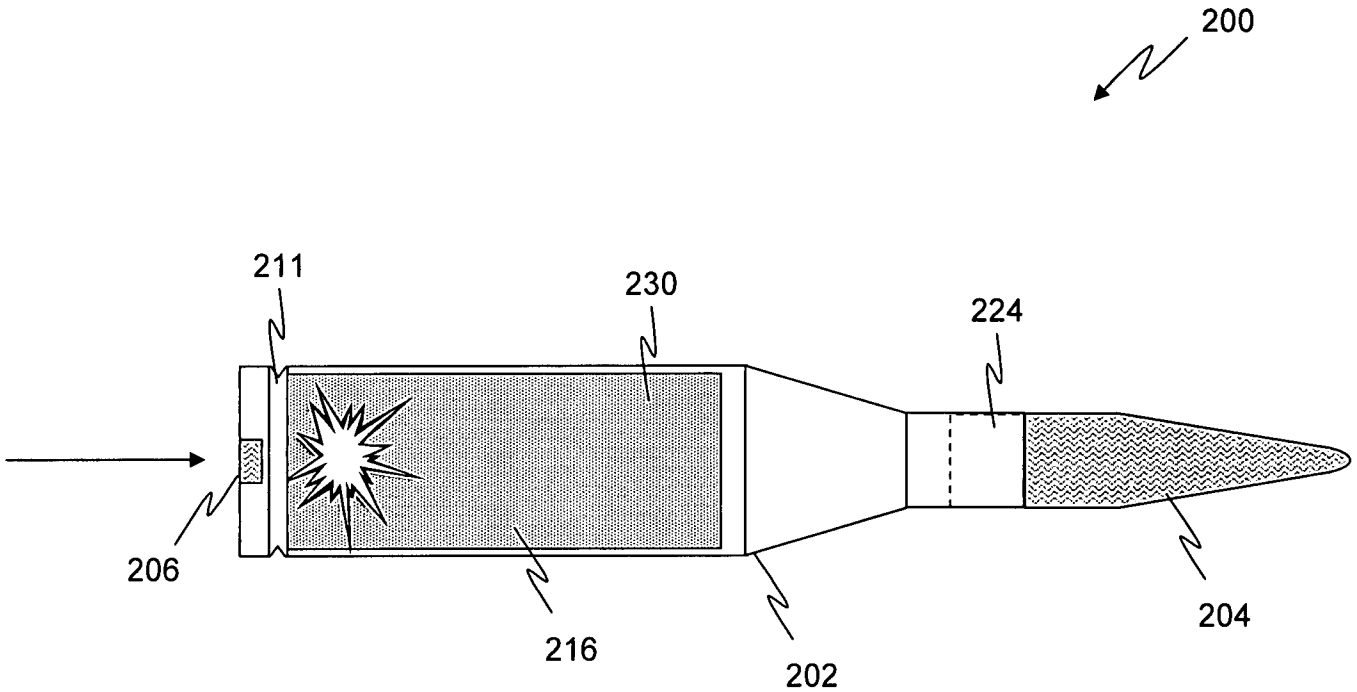
FIG. 8 is a side view of the improved 9 mm cartridge in FIG. 4 being fired.

Referring to FIG. 7 and FIG. 8, the bullet 204 may be frictionally associated with the cartridge case 202 via the top opening 218, wherein the bullet 204 is snugly and frictionally associated with the casing top portion 210 such that at least a portion of the bullet 204 is disposed within the casing top portion 210. It should be appreciated that the bullet 204 should be snugly associated with the cartridge case 202 such that the cartridge 200 includes a predetermined cartridge length V which may be approximately equal to 1.275 inches. Additionally, the cap 206 may be non-movably associated with the casing bottom portion 214 via the bottom opening 220, wherein the bottom opening 220 is shown as being disposed in the center portion of the casing bottom portion 214. The casing cavity 216 may include a propellant 230 and the cap 206 may include a catalyst, such that interaction with the cap 206, such as by the firing mechanism of a firearm, causes the catalyst to interact with the propellant 230 disposed within the casing cavity 216, either directly or indirectly, to cause the bullet 204 to be propelled rapidly away from the cartridge case 202. It should be appreciated that any propellant suitable to the desired end purpose may he used to propel the bullet 204 away from the cartridge case 202, such as solid propellants, liquid propellants, gas propellants and composite propellants.

Figure 9:
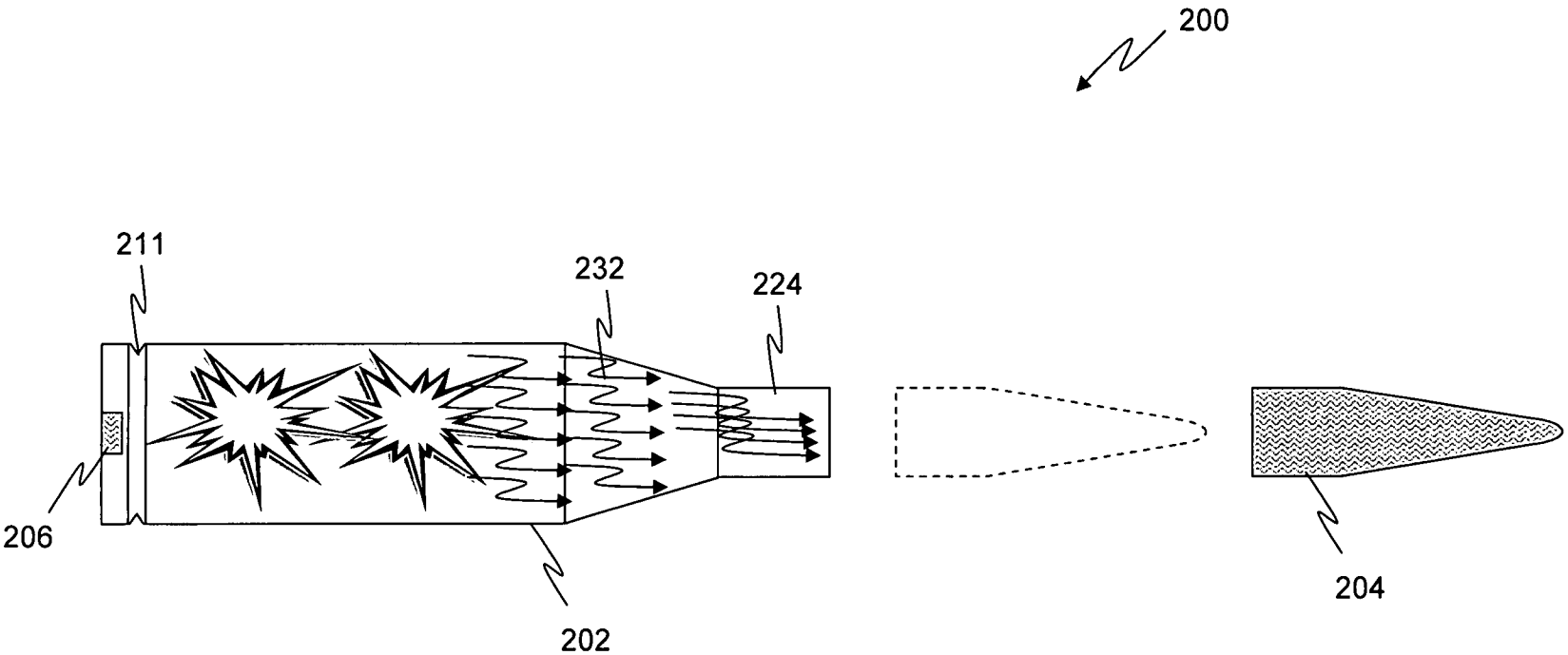
FIG. 9 is a side view of the improved 9 mm cartridge in FIG. 4 being fired.

For example, referring again to FIG. 8, the cartridge 200 is shown and includes a cartridge case 202, a bullet 204 and a primer or cap 206 (such as a centerfire percussion cap), wherein the cap 206 includes a catalyst, such as a high explosive material and wherein the cartridge case 202 includes a propellant 230, such as gun powder, disposed within the casing cavity 216. The bullet 204 is snugly associated with the top opening 218 of the cartridge case 202 to sealingly enclose the casing cavity 216. When the percussion cap 206 is struck by the firing pin of a firearm, the catalyst in the cap 206 ignites, causing the propellant 230 contained within the casing cavity 216 to ignite. Referring to FIG. 9, as the propellant 230 contained within the casing cavity 216 ignites, gas pressure 232 is built up within the casing cavity 216 and pushes against the bullet 204 forcing the bullet 204 away from the cartridge case 202 at a high velocity and down the barrel of the firearm. It is contemplated that the bullet 204 may include any bullet suitable to the desired end purpose having a mass of at least 90 grains and configured for firing from a 9 mm firearm. Moreover, the casing cavity 216 should be sized to have a volume large enough to hold enough propellant 230 to propel the bullet 204 at a velocity of at least 1600 feet per second (fps).

It should be appreciated that this invention allows for a 9 mm bullet 204 having a mass of at least 90 grains to achieve a larger amount of kinetic energy (i.e. mass×velocity) than the 9 mm bullets (projectiles) currently in use. Upon impact of the bullet 204 with a target, this larger kinetic energy translates into increased penetration and/or greater stopping power (i.e. lethality) than current 9 mm bullets (projectiles). Moreover, this invention also allows for the bullet 204 to have a larger weight range and larger velocity range than current 9 mm bullets allowing for the weight and velocity of the bullet 204 to be adjusted for a particular use and/or situation. Furthermore, it should be appreciated that the bullet 204 may be propelled from the barrel of any firearm suitable to the desired end purpose of firing the improved cartridge 200, including a 9 mm rifle, a 9 mm pistol, a 9 mm revolver and a 9 mm submachine gun.

It should be further appreciated that the cartridge case 202 may be constructed from any material or combination of materials suitable to the desired end purpose, such as brass, copper, zinc, steel, nickel. Furthermore, it should be appreciated that the bullet 204 may be constructed from any material or combination of materials suitable to the desired end purpose, such as lead, depleted Uranium, a copper alloy jacketed lead core material and/or any combination thereof.

Figure 10:
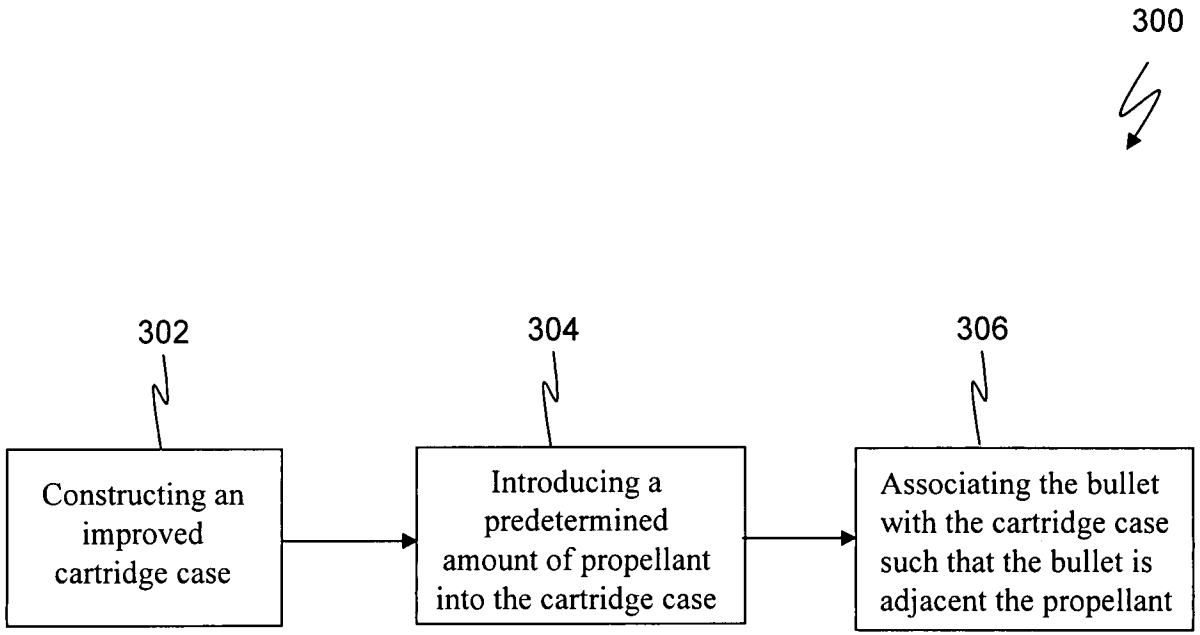
FIG. 10 is a block diagram illustrating a method for generating the improved 9 mm cartridge in FIG. 4.
Figure 11:
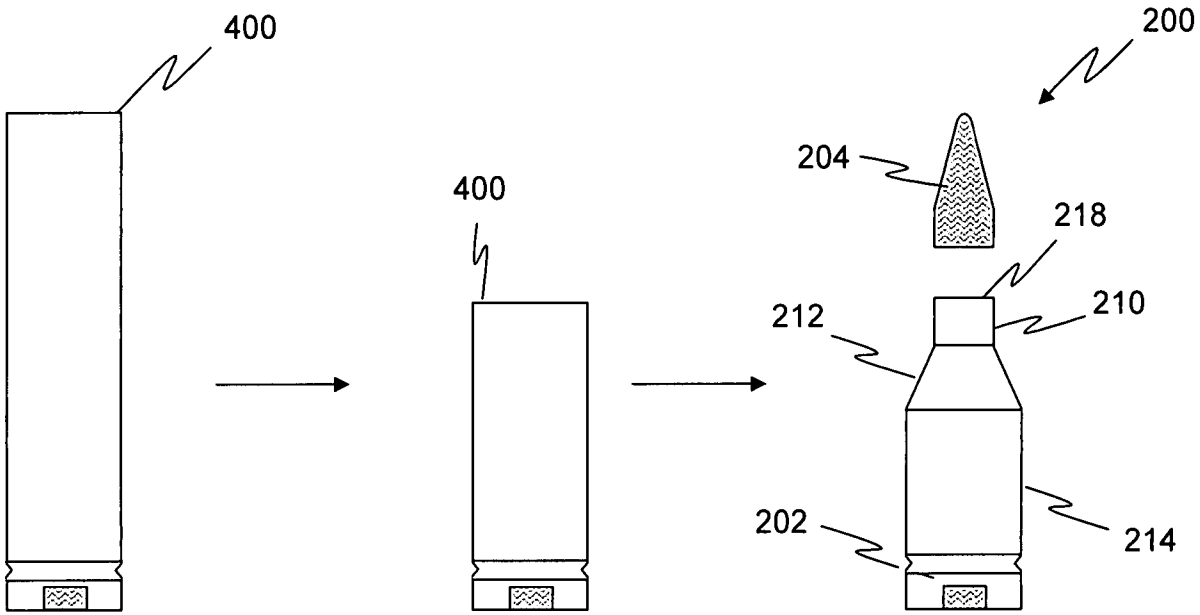
FIG. 11 is a side view of a 0.45 Winchester Magnum caliber cartridge being configured into the improved 9 mm cartridge in FIG. 4.
Figure 12:
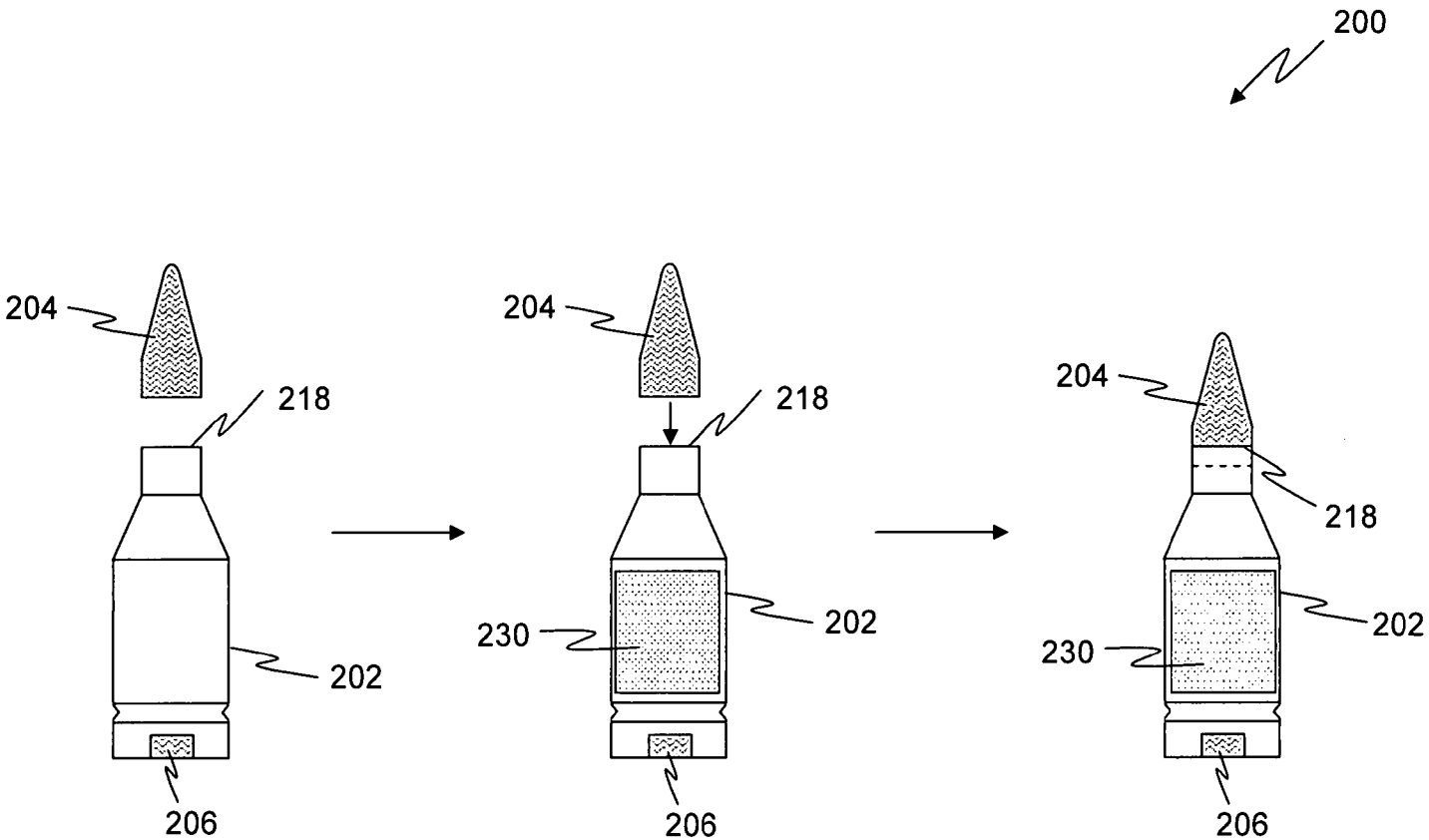
FIG. 12 is a side view of the improved 9 mm cartridge of FIG. 4 being generated using the improved 9 mm cartridge case in FIG. 5.

Referring to FIG. 10, a block diagram illustrating a method 300 for generating an improved 9 mm cartridge 200 is shown and includes constructing the cartridge case 202, as shown in operational block 302, wherein the cartridge case 202 includes the cap 206. This may be accomplished either by newly fabricating the cartridge case 202 or by modifying (i.e. cutting and necking down) the cartridge case of a 0.45 Winchester Magnum caliber cartridge 400 to achieve the dimensions of the cartridge case 202 as disclosed hereinabove and as shown in FIG. 11 and FIG. 12. The process of "cutting and necking down" involves physically resizing the length of the 0.45 Win Mag caliber cartridge case 400 by cutting or grinding away the case material disposed on the top portion of the 0.45 Win Mag caliber cartridge case 400 and resizing, or 'necking down,' the top portion 0.45 Win Mag caliber cartridge case 400 to form a casing top portion 210, a casing center portion 212 and a casing bottom portion 214 having the dimensions as discussed herein, wherein the casing top portion 210 is sized to securingly contain the 9 mm diameter bullet 204 while the casing bottom portion 214 is kept at the original size of the 0.45 Win Mag Case 400. It should be appreciated that in one embodiment the length of the cartridge may be sized and cut to a length approximately equal to 0.9880 inches, wherein the length may vary by a tolerance range of approximately ±0.004 inches.

The method 300 also includes introducing a predetermined amount of propellant 230 into the casing cavity 216, as shown in operational block 304. It should be appreciated that the amount of propellant 230 to be used with the bullet 204 may be varied in a manner responsive to the mass of the bullet 204 and the desired projectile velocity, wherein the amount of propellant 230 used should be sufficiently large to propel the bullet 204 to a velocity of at least 1600 feet per second (fps). Furthermore, the method includes associating the bullet 204 with the cartridge case 202, as shown in operational block 306, such that at least a portion of the bullet 204 is contained within the casing cavity 216. This may be accomplished via any method/device suitable to the desired end purpose, such as by compressing the bullet 204 into the top opening 218. It should be appreciated that although the bullet 204 may have a mass of at least 90 grains, the 9 mm diameter of the bullet 204 should remain unchanged.

Figure 13:
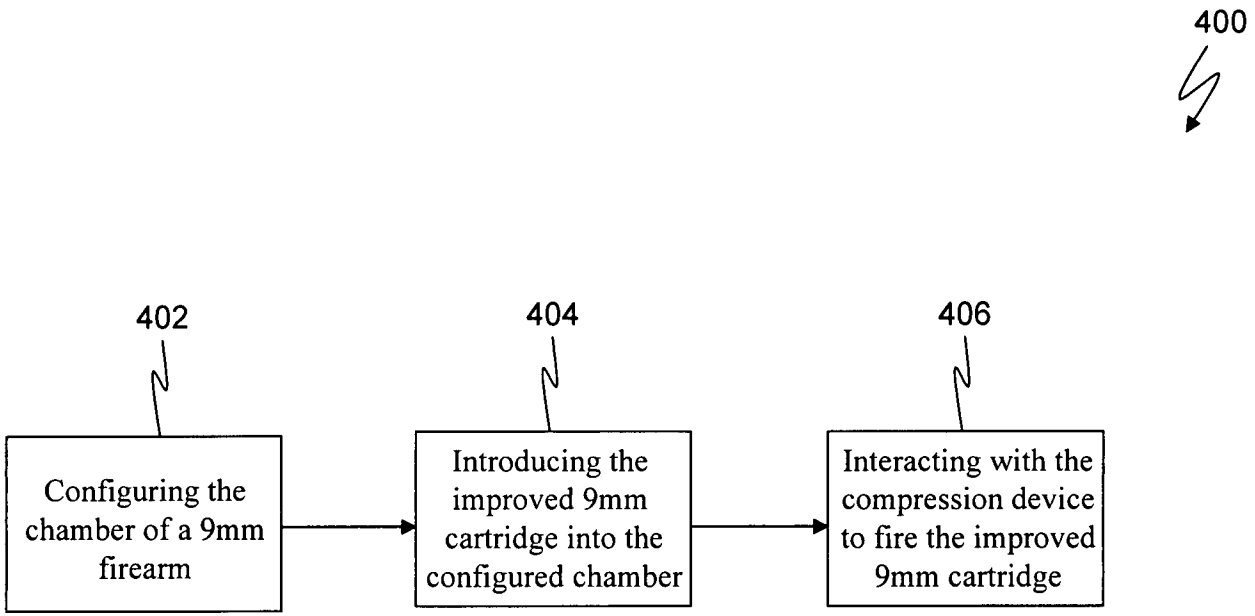
FIG. 13 is a block diagram illustrating a method for implementing the improved 9 mm cartridge in FIG. 4.
Figure 14:
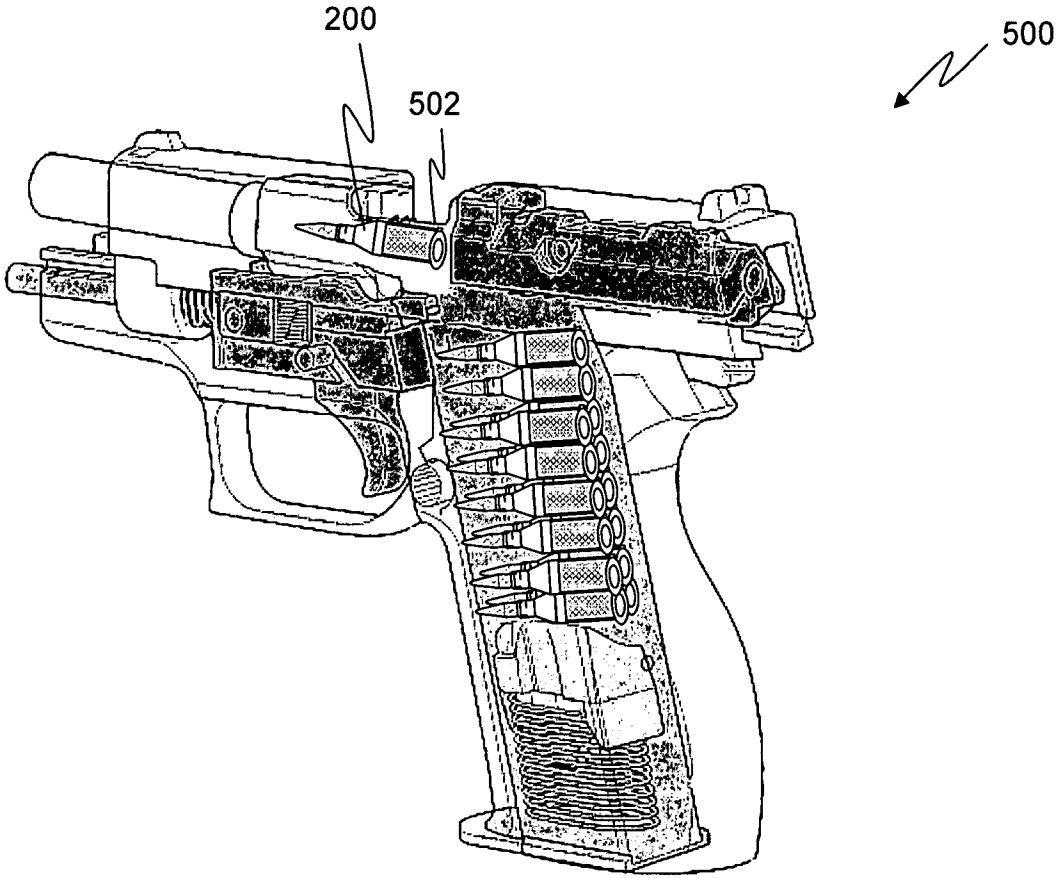
FIG. 14 is a side cross-sectional perspective view of a 9 mm firearm configured to interact with the improved 9 mm cartridge in FIG. 4.
Figure 15:
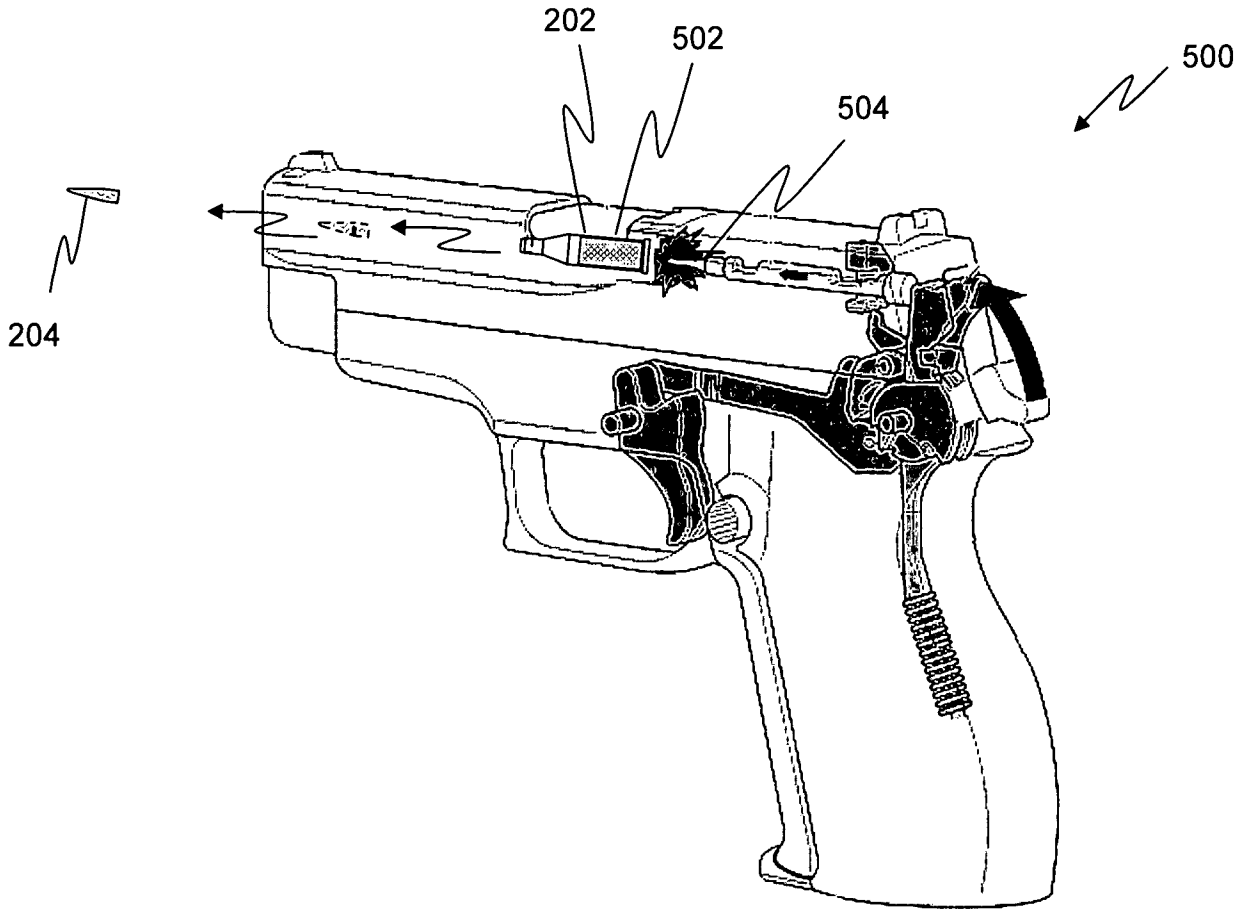
FIG. 15 is a side cross-sectional perspective view of a 9 mm firearm configured to interact with the improved 9 mm cartridge in FIG. 4.

Referring to FIG. 13, a block diagram describing a method 400 for implementing the improved 9 mm cartridge 200 is illustrated and includes configuring the chamber 502 of a 9 mm firearm 500 to hold the improved 9 mm cartridge 200, as shown in operational block 402. This may be accomplished by boring out or resizing the chamber 502 of the 9 mm firearm 500 via any method and/or device suitable to the desired end purpose, to operatively accommodate the casing of a 0.45 caliber Win Mag bullet. Referring to FIG. 14, the improved 9 mm cartridge 200 may then be introduced into the chamber 502 of the 9 mm firearm 500 such that the cap 206 is disposed adjacent the firing pin 504, as shown in operational block 404. The 9 mm cartridge 200 may then be fired from the 9 mm firearm 500 by interacting with a compression device or trigger 506 of the 9 mm firearm 500, causing the firing pin 504 to strike the cap 206 of the 9 mm cartridge 200, as shown in FIG. 15 and operational block 406.

It should be appreciated that each of the size/diameter dimensions described hereinabove are subject to a predetermined tolerance range of values, wherein the predetermined tolerance range of values may be between ±0.004 inches. Additionally, it should be appreciated that the angle $\beta$ is subject to a predetermined tolerance angle range, wherein the predetermined tolerance angle range may be between ±2°.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An improved 9 mm cartridge comprising:

a 9.0 mm bullet, wherein said 9.0 mm bullet weights at least 90 grains and is configured for operation with a 9 mm firearm;

a 0.45 caliber cartridge case having a length approximately equal to 0.9880 inches, wherein said 0.45 caliber cartridge case includes a case bottom portion communicated with a case top portion via a case middle portion having a case middle portion length that is approximately equal to 0.236 inches, said case bottom portion having a diameter that is larger in size than said case top portion such that said case middle portion diameter is tapered approximately equal to 20° between said case bottom portion and said case top portion, wherein said case bottom portion, said case middle portion and said case top portion define a case cavity and wherein said case top portion includes a top opening communicated with said case cavity, said top opening sized to interact with said 9.0 mm bullet, wherein said 9.0 mm bullet is frictionally associated with said top opening such that at least a portion of said 9.0 mm bullet is disposed within said case cavity;

a means for propelling said 9.0 mm bullet to a velocity of at least 1600 feet per second, wherein said means for propelling is at least partially disposed within said casing cavity; and a cap, wherein said cap is associated with said case bottom portion such that when said cap is engaged, said cap causes said means for propelling said 9.0 mm bullet to propellingly interact with said 9.0 mm bullet, wherein the cartridge has a length of approximately equal 1.275 inches.

2. The improved 9 mm cartridge of claim 1, wherein said case top portion includes a case top portion length approximately equal to 0.1285 inches and a case top portion diameter approximately equal to 0.3810 inches, wherein said case top portion length and said case top portion diameter may vary by a predetermined tolerance range.

3. The improved 9 mm cartridge of claim 2, wherein said case bottom portion includes a case bottom portion length approximately equal to 0.7480 inches and a case bottom portion diameter approximately equal to 0.4738 inches, wherein said case bottom portion length and said case bottom portion diameter may vary by said predetermined tolerance range.

4. The improved 9 mm cartridge of claim 3, wherein said case middle portion length may vary by said predetermined tolerance range and is tapered at an angle β relative to a plane parallel with said case bottom portion to communicate said case bottom portion with said case top portion.

5. The improved 9 mm cartridge of claim 4, wherein said predetermined tolerance range is approximately equal to ±0.004 inches.

6. The improved 9 mm cartridge of claim 4, wherein said angle β may vary by a predetermined angle tolerance range.

7. The improved 9 mm cartridge of claim 6, wherein said predetermined angle tolerance range is approximately equal to ±2 degrees.

8. The improved 9 mm cartridge according to claim 1, wherein said bullet includes a bullet mass of 90 grains.

9. The improved 9 mm cartridge according to claim 1, wherein said means for propelling includes gun powder.

10. The improved 9 mm cartridge of claim 1, wherein said 9 mm firearm is at least one of a 9 mm pistol, a 9 mm revolver, a 9 mm submachine gun and a 9 mm rifle.

11. An improved 9 mm cartridge comprising:

a 9.0 mm bullet, wherein said 9.0 mm bullet weights at least 90 grains and is configured for operation with a 9 mm firearm;

a 0.45 caliber cartridge case having a length approximately equal to 0.9880 inches, wherein said 0.45 caliber cartridge case includes a case bottom portion communicated with a case top portion via a case middle portion having a case middle portion length that is approximately equal to 0.236 inches, said case bottom portion having a diameter that is larger in size than said case top portion, wherein said case bottom portion includes a first case bottom portion diameter disposed on one end of said case bottom portion and approximately equal to ±0.4738 inches, and a second case bottom portion diameter disposed on an opposite end of said case bottom portion approximately equal to 0.4640 inches, wherein each of said case middle portion length, said first case bottom portion diameter and said second case bottom portion diameter may vary by a tolerance range of approximately ±0.004 inches, and wherein said case bottom portion, said case middle portion and said case top portion define a case cavity and wherein said case top portion includes a top opening communicated with said case cavity, said top opening being sized to operatively interact with said 9.0 mm bullet;

a means for propelling said 9.0 mm bullet to a velocity of at least 1600 feet per second, wherein said means for propelling is at least partially disposed within said casing cavity; and a cap, wherein said cap is associated with said case bottom portion such that when said cap is engaged, said cap causes said means for propelling said 9.0 mm bullet to propellingly interact with said 9.0 mm bullet, wherein the cartridge has a length of approximately equal 1.275 inches.

12. The improved 9 mm cartridge of claim 11, wherein said cartridge case is a 0.45 caliber cartridge case.

13. The improved 9 mm cartridge of claim 11, wherein said 9 mm firearm is at least one of a 9 mm pistol, a 9 mm revolver, a 9 mm submachine gun and a 9 mm rifle.

14. The improved 9 mm cartridge of claim 11, wherein said cartridge case is comprised of at least one of brass, copper, steel, zinc and nickel.

15. The improved 9 mm cartridge of claim 11, wherein said case bottom portion includes a case bottom portion diameter, wherein said case bottom portion diameter is substantially equal to the diameter of a 0.45 caliber cartridge.

16. A method for generating an improved 9 mm cartridge, the method comprising:

cutting a 0.45 caliber cartridge case to a length approximately equal to 0.9880 inches, wherein said 0.45 caliber cartridge case defines a case cavity and includes a cap, a case bottom portion having a case bottom portion diameter and a case top portion having a case top portion diameter, wherein said case bottom portion diameter is substantially equal to the diameter of a cartridge case configured for use with a 0.45 caliber firearm, said case top portion diameter is sized to operatively interact with a 9 mm firearm;

introducing a predetermined amount of propellant into said case cavity, said predetermined amount of propellant being sufficiently large to propel a 9.0 mm bullet having a mass of at least 90 grains to a velocity of at least 1600 feet per second; and associating said bullet with said cartridge case, such that said bullet is frictionally associated with said cartridge case.

17. The method of claim 16, wherein said length may vary by a tolerance range of approximately ±0.004 inches.

18. The method of claim 17, wherein said constructing further includes reshaping said cut 0.45 caliber cartridge to include a case center portion disposed to separate said case top portion and said case bottom portion, wherein said case top portion includes a case top portion diameter and said case bottom portion includes a case bottom portion diameter.

19. The method of claim 18, wherein said case center portion is tapered at an angle of 20 degrees relative to a plane disposed parallel to said case bottom portion, wherein said angle may vary by a tolerance range of approximately ±2 degrees.

20. The method of claim 16, wherein said firearm is at least one of a 9 mm pistol, a 9 mm revolver, a 9 mm submachine gun and a 9 mm rifle.

* * * * *